US007703765B2

(12) United States Patent
Standing

(10) Patent No.: US 7,703,765 B2
(45) Date of Patent: Apr. 27, 2010

(54) TRANSPORT BELT COOLING

(75) Inventor: Robert Charles Standing, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 663 days.

(21) Appl. No.: 11/462,425

(22) Filed: Aug. 4, 2006

(65) Prior Publication Data

US 2008/0034102 A1 Feb. 7, 2008

(51) Int. Cl.
*B65H 29/32* (2006.01)

(52) U.S. Cl. ..... 271/197; 271/276; 198/471.1

(58) Field of Classification Search ..... 271/276, 271/197; 198/471.1, 689.1, 811
See application file for complete search history.

(56) References Cited

U.S. PATENT DOCUMENTS 4,310,151 A * 1/1982 Fujimoto ..... 271/11
4,322,993 A * 4/1982 Stumpf ..... 198/689.1
4,476,756 A * 10/1984 Pearl et al. ..... 83/422
5,878,868 A * 3/1999 Gotoh et al. ..... 198/689.1
2002/0176723 A1 11/2002 Fletcher et al.
2004/0265025 A1 12/2004 Russel et al.
2006/0104678 A1 5/2006 Kuo et al.
2008/0073838 A1* 3/2008 Sakaida ..... 271/276

FOREIGN PATENT DOCUMENTS

JP 2001130771 A * 5/2001

* cited by examiner

*Primary Examiner*—Patrick Mackey
*Assistant Examiner*—Gerald W McClain
(74) *Attorney, Agent, or Firm*—Gibb I.P. Law Firm, LLC

(57) ABSTRACT

Embodiments herein include a printing or copying device that includes a media transport belt and a vacuum manifold. The vacuum manifold has an air intake positioned adjacent the media transport belt and has a vacuum blower or other air moving device that forces air out an air outlet of the manifold. The vacuum blower forces air from the vacuum manifold through the air outlet to create vacuum within the manifold. The vacuum manifold also includes transport belt openings that are sized, shaped, and positioned to allow the transport belt to pass into the vacuum manifold. The media transport belt is positioned partially within, and partially outside the vacuum manifold, such that the media transport belt is positioned to move through (within) the vacuum manifold from a first transport belt opening to a second transport belt opening.

17 Claims, 3 Drawing Sheets

TRANSPORT BELT COOLING

BACKGROUND

Embodiments herein generally relate to electrostatographic printers and copiers or reproduction machines, and more particularly, concerns a vacuum manifold that includes transport belt openings that are sized, shaped, and positioned to allow the transport belt to pass through the vacuum manifold.

One condition that can occur within devices that utilize belts to transport items, such as sheets of media, is that the belts can be undesirably heated by adjacent objects, such as fuser assemblies and other similar heat generating devices. When the media transport belts within printers and copiers become excessively hot, the transport belt can melt or disturb the image (especially duplex images) on the media being transported by the belt. Belts within printers (such as transfer or transport belts) can be cooled using thermally cooled rollers (for example U.S. Patent Publication Numbers 2002/0176723 and 2004/0265025) the complete disclosure of which is incorporated herein by reference.

For example, U.S. Patent Application No. 2004/0265025 explains that vacuum sheet transports can be desirable for certain paper paths of various xerographic printers and other sheet transporting applications, especially in high speed printers. For example, for providing the upstream and/or downstream sheet transports of the print media sheets to and from a thermal fuser in which xerographic toner images on the print media are fused onto the printed sheets. These sheet transports are typically known vacuum belt transports with spaced and/or apertured belts. However, it has been discovered that such sheet transports, especially when heated by thermal emissions from other components of the printer, such as the fuser, can impart visible defects in areas of the printed images in some cases.

Conventional systems also utilize vacuum manifolds to clean debris from belts within photocopiers and printers. For example, U.S. Patent Publication 2006/0104678 (the complete disclosure of which is incorporated herein by reference) discloses a vacuum manifold containing internal rotating brushes that are used to clean transfer belts in photocopiers.

SUMMARY

Embodiments herein include an apparatus, such as electrostatic or xerographic printing or copying device that includes a media transport belt and a vacuum manifold. The vacuum manifold has an air intake positioned adjacent to the media transport belt and has a vacuum blower or other air moving device. The vacuum blower faces air from the vacuum manifold through the air outlet to create vacuum within the manifold.

The vacuum manifold also includes transport belt openings that are sized, shaped, and positioned to allow the transport belt to pass into the vacuum manifold. The media transport belt is positioned partially within, and partially outside the vacuum manifold, such that the media transport belt is positioned to move through (within) the vacuum manifold from a first transport belt opening to a second transport belt opening.

The transport belt openings can be positioned to oppose one another across a width of the vacuum manifold. If desired, the transport belt openings within the vacuum manifold can include fixed or rotating brushes that help clean debris from the media transport belt.

When outside the manifold, the media transport belt moves over rollers exterior to the manifold to transport media from a first device (such as a fuser) to a second device (such as a decurler). When moving outside the vacuum manifold, the media transport belt moves from the second opening back to the first opening.

Further, the vacuum manifold can include one or more media transport belt rollers positioned within the vacuum manifold. In such a case, the media transport belt roller is positioned to contact a portion of the media transport belt that is within the vacuum manifold.

The air inlet and the air outlet are positioned to cause the vacuum blower to move air across the media transport belt as the media transport belt passes through the vacuum manifold from one transport belt opening the other transport belt opening to simultaneously cool and clean the media transport belt.

These and other features are described in, or are apparent from, the following detailed description.

BRIEF DESCRIPTION OF THE DRAWINGS

Various exemplary embodiments of the systems and methods are described in detail below, with reference to the attached drawing figures, in which.

DETAILED DESCRIPTION

As mentioned above, one condition that can occur within devices that utilize belts to transport items, such as sheets of media, is that the belts can be undesirably heated by adjacent objects, such as fuser assemblies and other similar heat generating devices. When the media transport belts within printers and copiers become excessively hot, the transport belt can melt or disturb the image (especially duplex images) on the media being transported by the belt. The structure provides cooling to the transport belt, without the need for cooling rollers or substantial modifications to existing structures.

Figure 1:
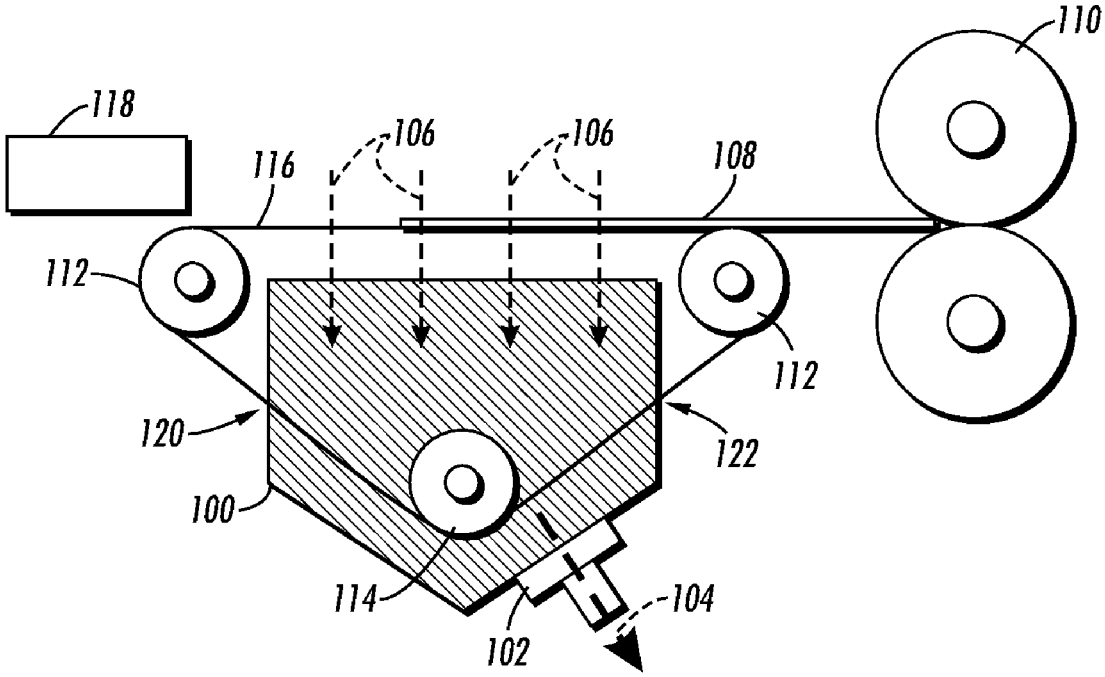
FIG. 1 is a schematic diagram of a side-view of a vacuum manifold system according to embodiments herein.

Embodiments herein include an apparatus, such as electrostatic or xerographic printing or copying device that includes a vacuum media transport belt and a vacuum manifold. As shown in FIG. 1, the vacuum manifold 100 has one or more air intakes (shown by arrows 106) positioned to provide suction to the media transport belt 116 to maintain media sheets 108 thereon. The system includes a vacuum blower 102 or other air moving device which can be positioned next to an air outlet (shown by arrow 104) of the manifold 100 or can be positioned at any other location that causes air to be forced out of (or drawn through) the air outlet 104. The vacuum blower 102 draws air from the vacuum manifold 100 through the air outlet 104 to create vacuum within the manifold 100.

While the air intakes 106 and the air outlet 104 are shown in specific positions in FIG. 1, they can be located in any position and can have any shape, depending on the specific requirements of the machine in which they will ultimately be used. Thus, while the vacuum manifold 100 is shown as having 5 sides, the manifold could comprise a rounded structure, or a structure with a number of different sides, as such vacuum manifolds often have to be positioned between various tightly spaced internal devices of the machine in which they work. Similarly, the vacuum blower 102 does not need to be directly connected to the vacuum manifold but instead can be connected by way of ducting, as shown in U.S. Patent Publication number 2004/0245711, the complete disclosure of which is incorporated herein by reference.

Figure 3:
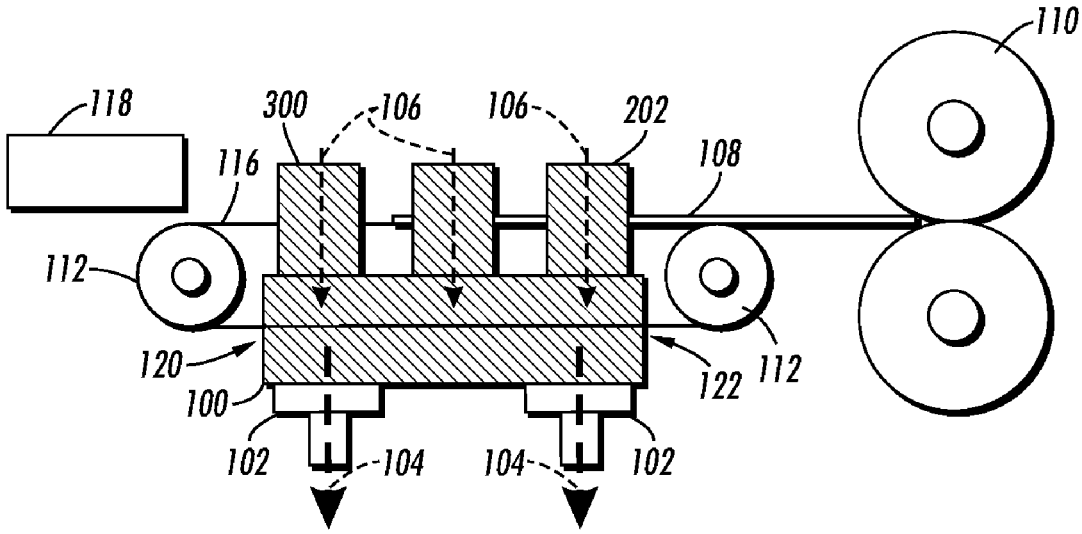
FIG. 3 is a schematic diagram of a side-view of a vacuum manifold system according to embodiments herein.

The vacuum manifold 100 also includes at least two transport belt openings 120, 122 that are sized, shaped, and positioned to match the shape of the transport belt 116 to allow the transport belt 116 to pass into the vacuum manifold 100 without losing substantial vacuum (air volume). For example, as shown in FIG. 3, the transport belt openings 120, 122 can comprise a rectangular or slip-like opening. The media transport belt 116 is positioned partially within, and partially outside the vacuum manifold 100, such that the media transport belt 116 is positioned to move through (within) the vacuum manifold 100 from one transport belt opening 120 to a second transport belt opening 122.

When outside the manifold 100, the media transport belt moves over rollers 112 exterior to the manifold 100 to transport media 108 (such as paper, transparencies, card stock, etc.) from a first device (such as a fuser 110) to a second device (such as a decurler, inverter, finisher 118, etc.). When moving outside the vacuum manifold 100, the media transport belt 116 moves from the second opening 122 back to the first opening 120.

By creating a vacuum within the vacuum manifold 100, vacuum is also created at the air intakes 116, which draws air from the media transport belt 116 into the vacuum manifold 100 to help hold the media sheet 108 on the media transport belt 116. The air (and any debris) can exit through the air outlet(s) 104. In addition, by passing the media transport belt 116 through the vacuum manifold 100, the media transport belt is cooled by the large air flow passing within the vacuum manifold 100. The large air flow passing within the vacuum manifold 100 can also remove debris from the media transport belt 116. Therefore, the embodiment shown in FIG. 1 provides simultaneous vacuuming force for holding media sheets 108 on the media transfer belt 116 and cooling and debris removal to help cool and clean the media transport belt 116.

With the structure the conventional vacuum manifold that is utilized to provide vacuum to the media transport belt can be easily modified to include media transport belt openings. Therefore, the structure can be easily incorporated into existing printers, copiers and other apparatus that utilize vacuum belts to transport media. In other words, the structure can utilize the existing vacuum manifold, the existing blower motor, etc. and, with a slight modification to the positions of the rollers and the addition of transport belt openings, can provide a substantial improvement directed toward cooling and cleaning the transport belt.

Figure 2:
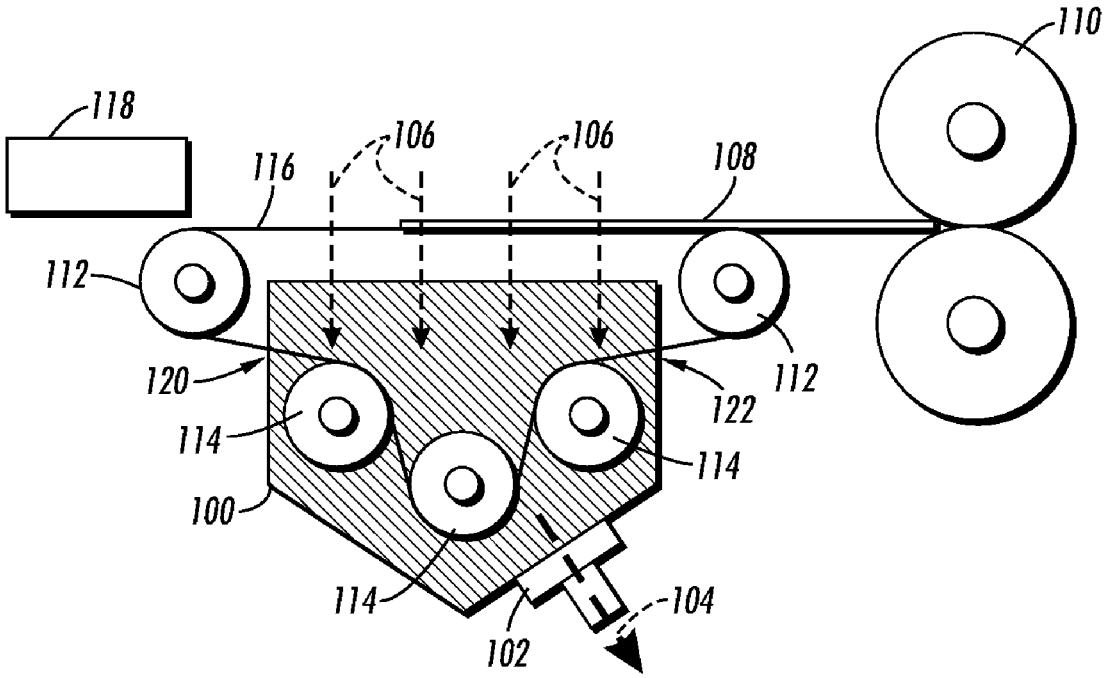
FIG. 2 is a schematic diagram of a side-view of a vacuum manifold system according to embodiments herein.

Further, as shown in the embodiment illustrated in FIG. 1, the vacuum manifold 100 can include one or more media transport belt rollers 114 positioned within the vacuum manifold 100. In such a case, the internal media transport belt roller 114 is positioned to contact a portion of the media transport belt 116 that is within the vacuum manifold 100. While only one internal media transport belt roller 114 is illustrated in FIG. 1, any number of internal media transport belt rollers 114 can be utilized depending upon the specific application of the structure. For example, FIG. 2 illustrates three internal media transport belt rollers 114. One advantage and including one or more internal media transport belt rollers 114 within the vacuum manifold 100 is that such a structure allows additional cooling and debris removal by causing the media transport belt 116 to remain within the vacuum manifold 100 longer and by causing the media transport belt 116 to be subjected to different angles of air flow while within the vacuum manifold 100.

Figure 4:
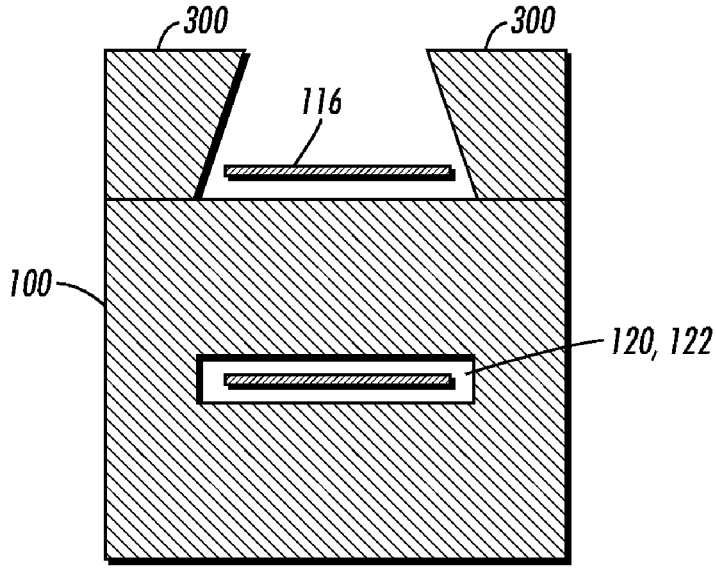
FIG. 4 is a schematic diagram of an end-view of a vacuum manifold system according to embodiments herein.

FIG. 3 illustrates different embodiments that the structure can include depending upon different specific applications of the structure. For example, the structure shown in FIG. 3 does not include the internal media transport belt rollers 114. However, the embodiment shown in FIG. 3 can include multiple blowers 102 and air outlets 104. Further, the structure shown in FIG. 3 can include angled air intake ports 300 that rise above, and partly or completely surround the media transport belt 116 and help remove debris (toner, dust, remnants of paper, etc.) from the belt. While FIGS. 1-3 illustrate a side-view, FIG. 4 illustrates an end view which selectively illustrates a cross-section of the media transport belt 116, the vacuum manifold 100, one of the openings 120, 122, as well as the raised angled intake ports 300. While the raised angled intake ports 300 are illustrated as having a certain shape, the embodiments herein are not limited to such a shape and the structure can include intake ports having any shape, in a similar manner that the vacuum manifold 100 can take any shape and size. Further, the intake ports 300 can comprise an integral part of the vacuum manifold 100 or can comprise separate features that are connected to the vacuum manifold 100.

The air inlets 106 and the air outlet 104 are positioned to cause the vacuum blower 102 to move air across the media transport belt 116 as the media transport belt 116 passes through the vacuum manifold 100 from one transport belt opening to another transport belt opening to simultaneously cool and clean the media transport belt 116. The transport belt openings 120, 122 can be positioned to oppose one another across a width or length of the vacuum manifold 100.

Figure 5:
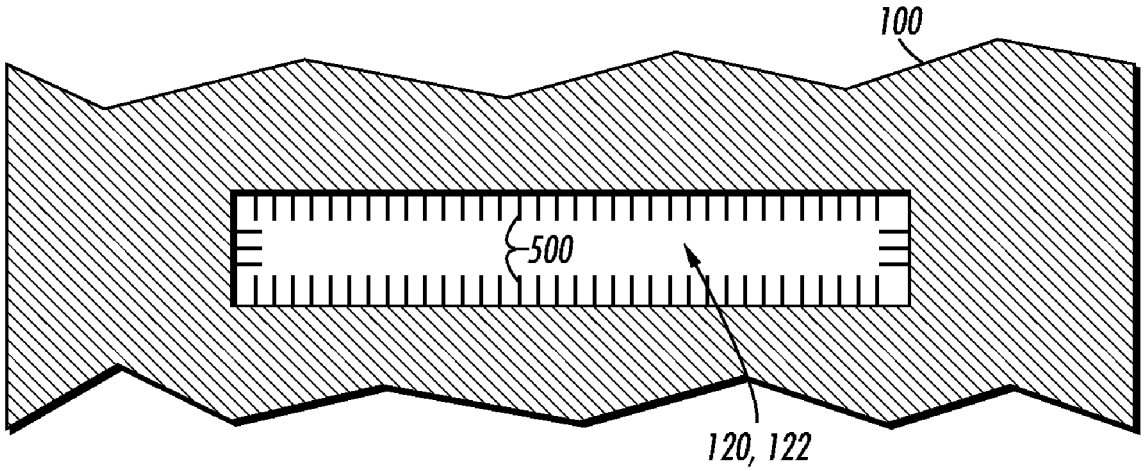
FIG. 5 is a schematic diagram of an end-view of media transport belt openings of a vacuum manifold according to embodiments herein.

FIG. 5 illustrates the transport belt openings 120, 122 in greater detail. As shown in FIG. 5, the transport belt openings 120, 122 within the vacuum manifold 100 can include fixed or rotating brushes 500 that help clean debris from the media transport belt 116. If the brushes 500 are rotating brushes, the brushes are mounted on axels (which are positioned along the edges of the transport belt openings 120, 122) which rotate under the influence of a motor or a pulley system. The details of rotating brushes are well-known to those ordinarily skilled in the art, for example, see U.S. Patent Publication 2006/0104678, the complete disclosure of which is incorporated herein by reference. Further, the brushes 500 can be mounted among all surfaces of the transport belt openings 120, 122 (as is illustrated in FIG. 5) or the brushes can be mounted among less than all the surfaces of the transport belt openings 120, 122 (e.g., just the top, or just the top and bottom).

The word "printer" or "image output terminal" as used herein encompasses any apparatus, such as a digital copier, bookmaking machine, facsimile machine, multi-function machine, etc. which performs a print outputting function for any purpose. The details of printers, printing engines, etc. are well-known by those ordinarily skilled in the art and are discussed in, for example, U.S. Pat. No. 6,032,004, the complete disclosure of which is fully incorporated herein by reference. The embodiments herein can encompass embodiments that print in color, monochrome, or handle color or monochrome image data. All foregoing embodiments are specifically applicable to electrostatographic and/or xerographic machines and/or processes.

Thus, as shown above, the inventive vacuum manifold includes transport belt openings that are sized, shaped, and positioned to allow the transport belt to pass into the vacuum manifold. The media transport belt is positioned partially within, and partially outside the vacuum manifold, such that the media transport belt is positioned to move through (within) the vacuum manifold from a first transport belt opening to a second transport belt opening. If desired, the transport belt openings within the vacuum manifold can include fixed or rotating brushes that help clean debris from the media transport belt.

The vacuum manifold can include one or more media transport belt rollers positioned within the vacuum manifold. In such a case, the media transport belt roller is positioned to contact a portion of the media transport belt that is within the vacuum manifold.

The air inlet and the air outlet are positioned to cause the vacuum blower to move air across the media transport belt as the media transport belt passes through the vacuum manifold from one transport belt opening to another transport belt opening to simultaneously cool and clean the media transport belt.

As mentioned above, one condition that can occur within devices that utilize belts to transport items, such as sheets of media, is that the belts can be undesirably heated by adjacent objects, such as fuser assemblies and other similar heat generating devices. The structure provides cooling to the transport belt, without the need for cooling rollers or substantial modifications to existing structures. With the structure, the conventional vacuum manifold utilized to provide vacuum to the media transport belt can be easily modified to include media transport belt openings. Therefore, the structure can be simply incorporated into existing printers, copiers and other apparatus that utilize vacuum belts to transport media. In other words, the structure can utilize the existing vacuum manifold, the existing blower motor, etc. and, with a slight modification to the positions of the rollers and the addition of transport belt openings, can provide a substantial improvement directed toward cooling and cleaning the transport belt. Thus, the invention provides substantial benefits for cooling and cleaning the transport belts, without a corresponding increase in cost, weight, or size of the device.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. The claims can encompass embodiments in hardware, software, and/or a combination thereof. Unless specifically defined in a specific claim itself, steps or components of the invention should not be implied or imported from any above example as limitations to any particular order, number, position, size, shape, angle, color, or material.

What is claimed is:

1. An apparatus comprising:

a vacuum manifold having an air intake positioned adjacent a media transport belt, wherein said vacuum manifold further comprises an air outlet; and a vacuum blower connected to said vacuum manifold and being adapted to draw air through said vacuum manifold from said air intake to said air outlet;

wherein said vacuum manifold further comprises at least two transport belt openings; and wherein said transport belt openings comprise surfaces on which brushes are mounted.

2. The apparatus according to claim 1, wherein said transport belt openings are positioned to oppose one another across a width of said vacuum manifold.

3. The apparatus according to claim 1, wherein said air inlet and said air outlet are positioned to cause said vacuum blower to move air across said media transport belt passing through said vacuum manifold from one transport belt opening to another transport belt opening of said transport belt openings.

4. The apparatus according to claim 1, wherein said transport belt openings are sized and shaped to allow said media transport belt to pass within said vacuum manifold.

5. An apparatus comprising:

a vacuum manifold having an air intake positioned adjacent a media transport belt, wherein said vacuum manifold further comprises an air outlet, and at least two transport belt openings allowing said media transport belt to pass through said vacuum manifold;

a vacuum blower connected to said vacuum manifold and being adapted to draw air through said vacuum manifold from said air intake to said air outlet;

at least one media transport belt roller positioned within said vacuum manifold and contacting said media transport belt; and wherein said transport belt openings comprise surfaces on which brushes are mounted.

6. The apparatus according to claim 5, wherein said transport belt openings are positioned to oppose one another across a width of said vacuum manifold.

7. The apparatus according to claim 5, wherein said air inlet and said air outlet are positioned to cause said vacuum blower to move air across said media transport belt passing through said vacuum manifold from one transport belt opening to another transport belt opening of said transport belt openings.

8. The apparatus according to claim 5, wherein said transport belt openings are sized and shaped to allow said media transport belt to pass within said vacuum manifold.

9. An apparatus comprising:

a media transport belt;

a vacuum manifold having an air intake positioned adjacent said media transport belt, wherein said vacuum manifold further comprises an air outlet; and a vacuum blower connected to said vacuum manifold and being adapted to draw air through said vacuum manifold from said air intake to said air outlet;

wherein said vacuum manifold further comprises at least two transport belt openings;

wherein said media transport belt is positioned partially within said vacuum manifold, such that said media transport belt is positioned to move within and through said vacuum manifold from one transport belt opening to another transport belt opening of said transport belt openings; and wherein said transport belt openings comprise surfaces on which brushes are mounted.

10. The apparatus according to claim 9, wherein said transport belt openings are positioned to oppose one another across a width of said vacuum manifold.

11. The apparatus according to claim 9, wherein said air inlet and said air outlet are positioned to cause said vacuum blower to move air across said media transport belt as said media transport belt passes through said vacuum manifold from said one transport belt opening to said another transport belt opening.

12. The apparatus according to claim 9, wherein said transport belt openings are sized and shaped to allow said media transport belt to pass within said vacuum manifold.

13. An apparatus comprising:

a media transport belt;

a vacuum manifold having an air intake positioned adjacent said media transport belt, wherein said vacuum manifold further comprises an air outlet;

a vacuum blower connected to said vacuum manifold and being adapted to draw air through said vacuum manifold from said air intake to said air outlet;

wherein said vacuum manifold further comprises at least two transport belt openings; and at least one media transport belt roller positioned within said vacuum manifold, wherein said media transport belt is positioned partially within said vacuum manifold, such that said media transport belt is positioned to move through said vacuum manifold from one transport belt opening to another transport belt opening of said transport belt openings, wherein said media transport belt roller is positioned to contact a portion of said media transport belt that is within said vacuum manifold; and wherein said transport belt openings comprise surfaces on which brushes are mounted.

14. The apparatus according to claim 13, wherein said transport belt openings are positioned to oppose one another across a width of said vacuum manifold.

15. The apparatus according to claim 13, wherein said air inlet and said air outlet are positioned to cause said vacuum blower to move air across said media transport belt as said media transport belt passes through said vacuum manifold from said one transport belt opening to said another transport belt opening.

16. The apparatus according to claim 13, wherein said transport belt openings are sized and shaped to allow said media transport belt to pass within said vacuum manifold.

17. The apparatus according to claim 13, wherein said apparatus comprises one of an electrostatic printing device, an electrostatic copying device, an xerographic printing device and a xerographic copying device.

* * * * *